US006023790A

United States Patent [19]

Schwartz

[11] Patent Number: 6,023,790

[45] **Date of Patent: *Feb. 15, 2000**

[54] MAILABLE DISPLAY DEVICE

[76] Inventor: Frederick B. Schwartz, 4683 Mission Blvd., San Diego, Calif. 92109

[ * ] Notice: This patent is subject to a terminal disclaimer.

[21] Appl. No.: 09/046,110

[22] Filed: Mar. 23, 1998

Related U.S. Application Data

[63] Continuation-in-part of application No. 08/726,912, Oct. 7, 1996.

[60] Provisional application No. 60/005,036, Oct. 10, 1996, and provisional application No. 60/041,584, Mar. 24, 1997.

[51] Int. Cl.[7] ..... A41D 27/20

[52] U.S. Cl. ..... 2/247; 2/243.1; 2/94; 2/250; 2/252; 40/537

[58] Field of Search ..... 2/69, 69.5, 46, 2/47, 48, 49.1–49.5, 50–51, 57, 75, 80, 83, 104–106, 113–115, 247–253, 244, 243.1; 40/776, 765, 537; 229/92.8

[56] References Cited

U.S. PATENT DOCUMENTS

| | | | |
|---|---|---|---|
| 2,177,150 | 10/1939 | Perera et al. | 40/158 |
| 3,370,365 | 2/1968 | Vosbikian | 40/10 |
| 3,624,686 | 11/1971 | Beals | 2/48 |
| 4,218,781 | 8/1980 | Lieberman | 2/247 |
| 4,321,710 | 3/1982 | Off | 2/247 |
| 4,413,434 | 11/1983 | Rupert et al. | 40/10 R |
| 4,602,390 | 7/1986 | Morera et al. | 2/251 |
| 4,953,780 | 9/1990 | Ross | 229/92.8 |
| 5,025,581 | 6/1991 | Polzin | 40/159 |
| 5,045,139 | 9/1991 | Vonk | 156/152 |
| 5,337,949 | 8/1994 | Seeley | 229/92.8 |
| 5,499,404 | 3/1996 | Harrigan | 2/247 |
| 5,737,775 | 4/1998 | Schwartz | 2/247 |
| 5,788,144 | 8/1998 | Sorge et al. | 229/92.8 |
| 5,833,129 | 11/1998 | Smith | 229/92.8 |

*Primary Examiner*—Gloria M. Hale
*Assistant Examiner*—Tejash Patel
*Attorney, Agent, or Firm*—Henri J. A. Charmasson; John D. Buchaca

[57] ABSTRACT

A removable pocket is formed over a flat surface such as the front of a shirt by adhesively securing to the fabric a treated and embossed label-type appliqué made of two plies of paper permanently bonded about their peripheries and in which a slit along a top edge allows access to the pouch thus formed between plies. The pouch may be filled with merchandise and temporarily sealed with a removable strip. A postcard format printed in the back of the removable pocket allows its use as a mailer. A type of pouch having a transparent front may be conveniently used as a document display. The above-described various devices are preferably manufactured using label printing presses that print a glue pattern that binds the edges of the plies.

16 Claims, 5 Drawing Sheets

10
12
13
14
15
16
17
18
19
20
21
22
23
24
46
47
48
49
50
51
52
53
54
55
18A
X
X'
Y
Y'
2
2

MAILABLE DISPLAY DEVICE

PRIOR APPLICATION

This is a continuation-in-part application of copending application Ser. No. 08/726,912 filed Oct. 7, 1996, a continuation-in-part of Provisional Application Ser. No. 60/005,036 filed Oct. 10, 1996; and a continuation-in-part of Provisional Application Ser. No. 60/041,584 filed Mar. 24, 1997.

FIELD OF THE INVENTION

This invention relates to the manufacture of wearing apparel and the application thereto of badges, insignia and other information-carrying devices and more specifically to a way of quickly and removably forming a message-carrying pocket over the surface of a garment. This invention also relates to document displays, holders and mailers.

BACKGROUND OF THE INVENTION

Jackets, shirts and similar garments are often decorated in their frontal area with embroidery or appliqués, and adorned with badges or message-carrying buttons. Many of such garments, especially T-shirts, do not have breast pockets which are so convenient for holding pens, sunglasses or small documents. People are fond of displaying indicia of their membership in a particular group or organization, or of their enthusiasm and support for a sports team or popular idol.

The invention results from an attempt to combine in a single item, the convenience of an added pocket with a message or symbol-carrying device that can be quickly and removably placed on a piece of clothing. The device can also be adapted to the display and mailing of documents particularly photographs.

SUMMARY OF THE INVENTION

A principal object of this invention is to provide a disposable pocket that can be removably affixed to any suppor at such as a wall or a piece of clothing, and that can be marked with a decorative or informative graphic message.

Another object of the invention is to provide such a device in an inexpensive and easy to manufacture version that lends itself to a great variety of expressive configurations.

A further object of this invention is to provide a package for candy, chewing gum, and other small articles that can be affixed to a garment to form a reusable but removable and disposable pocket.

It is also an object of this invention to manufacture removable pockets, document displays and document mailers by means of printing presses such as used in making labels with adhesive backing as disclosed in the parent application.

These and other valuable objects are achieved by forming a pocket over a section of a fabric such as the front of a shirt by adhesively securing to the fabric, a printed and embossed label-type appliqué made of two plies of paper permanently bonded about their peripheries and provided with a slit along a top edge which provides a peelable access to the pouch formed between the plies. The front outer surface of the pocket is preferably decorated with an emblem or advertising message that can be used to display ones affiliation with a club or other membership association, or ones support for a political candidate, sports team or favorite champion.

In the manufacture of the aforesaid pockets suitable for use as displays and mailers for documents such as photographs, printing presses are used to print glue patterns that hold the peripheral edges of the new device plies, as disclosed herein and in the parent application Ser. No. 08/726,912, which application is incorporated in this specification by this reference.

DESCRIPTION OF THE PREFERRED EMBODIMENT OF THE INVENTION

Figures 1, 2, 4:
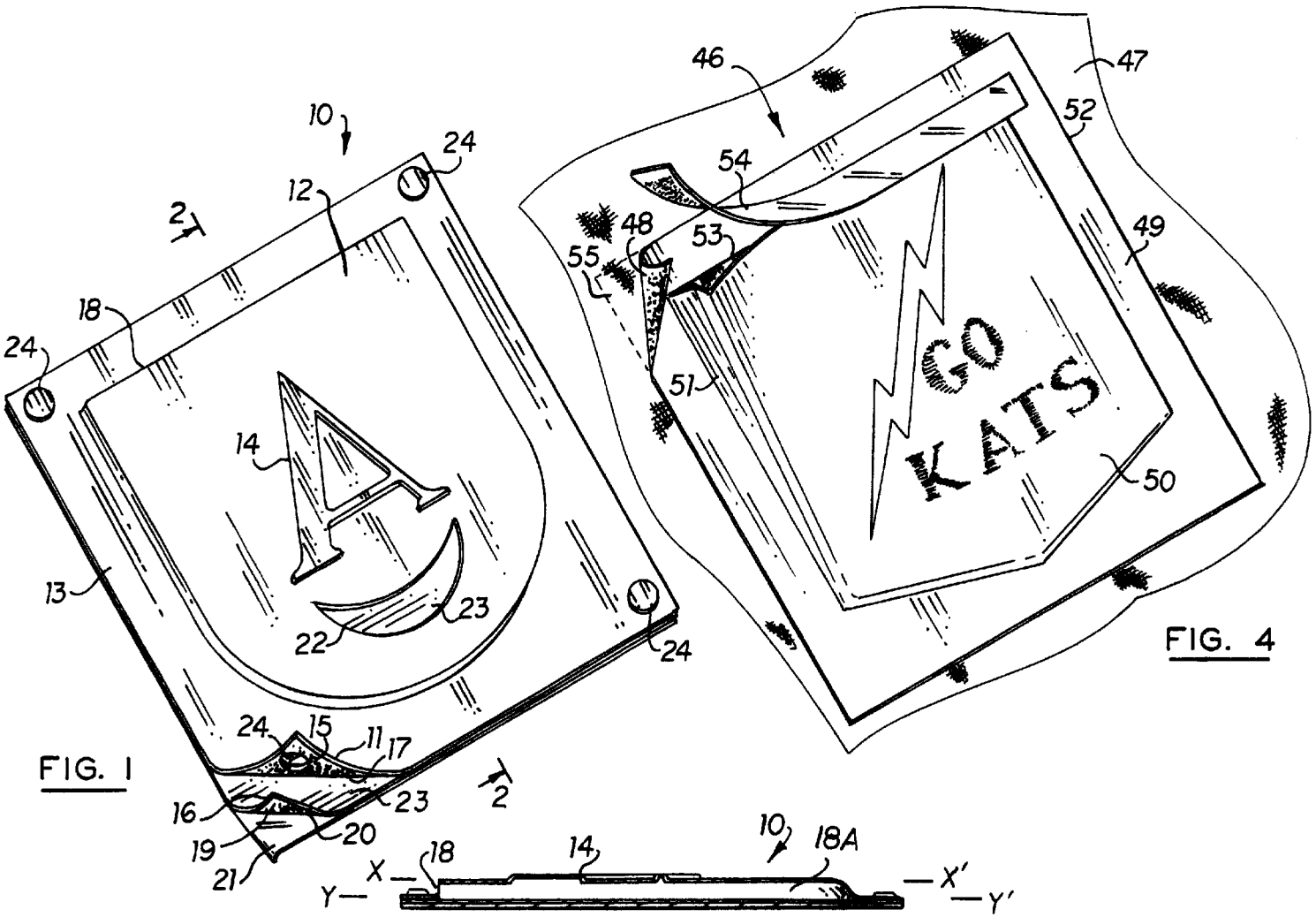
FIG. 1 is an isometric view of the preferred embodiment of the invention.
FIG. 2 is a cross-sectional view thereto taken along line 2—2 of FIG. 1.
FIG. 4 is an isometric view of an alternate embodiment of the invention applied to a wearing apparel.

Referring now to the drawing, there is shown in FIGS. 1 and 2 a multi-ply, disposable pocket 10 that can be removably applied to a preferably smooth and seamless woven fabric surface of a garment or to any other substantially flat surface. The pocket comprises a first sheet of material 11 having a central portion 12 that has been embossed to raise it to a plane X–X' parallel and spaced-apart from the original plane Y–Y' of the remaining peripheral portion 13 of the sheet surrounding said central portion 12. The embossing depth may be limited to one or two millimeters (40 to 80 mils). Graphic information 14 such as a symbol, emblem, design, or written message is applied to the central portion 12 by embossing, printing, painting, silk-screening, or a combination of those methods. The back face 15 of the first sheet 11 is permanently bonded about its peripheral portion 13 to the outer face of an intermediary sheet 16 with a strong rubber-based hot-melt adhesive 17 or by heat-sealing. A slit 18 cut along the upper edge of the central portion 12 provides access to the pouch 18A formed between the central portion of the first sheet and the intermediary sheets. The entire inner side 19 of the intermediary sheet is covered with a layer of high-tack, acrylic adhesive 20 which retains a high coefficient of friction and provides a strong but breakable bond when placed in contact with another surface such as a woven fabric. From the time of manufacture until the pocket is readied to be applied to a garment, the layer of acrylic adhesive 20 on the entire inner side of the intermediary sheet is protected by a peelable film 21 which is impregnated with wax or silicon for easy separation from the adhesive. The first and intermediary sheets 11, 16 are preferably made of a strong, high-rag content, bond stock of paper, a vinyl-coated fabric, natural or synthetic, woven or pile fabric, or any synthetic pliable sheet material, or a laminated or non-laminated multi-ply combination thereof. The first sheet should have a minimum degree of ductility and a high resistance to tearing. In addition to, or in lieu of the embossed or printed graphic information 14 the central portion 12 can be die-cut to form a decorative pattern 22 through which a section of the outer side 23 of the intermediary sheet can be seen.

It thus can be understood that a removable and disposable pocket can be instantly formed over an outer or inner surface of a garment by peeling and pressing the inner side of the intermediary sheet against a section of the garment surface. A more permanent type of pocket can be formed by replacing the high-tack acrylic adhesive 20 with a stronger thermoplastic-type that would allow ironing the pocket over the cloth fabric.

It should be noted that decorative printing or embossing can also be applied to the peripheral section 13 of the first sheet as illustrated by the rivets simulated by the embossing 24 at the four corners of the device.

Figure 3:
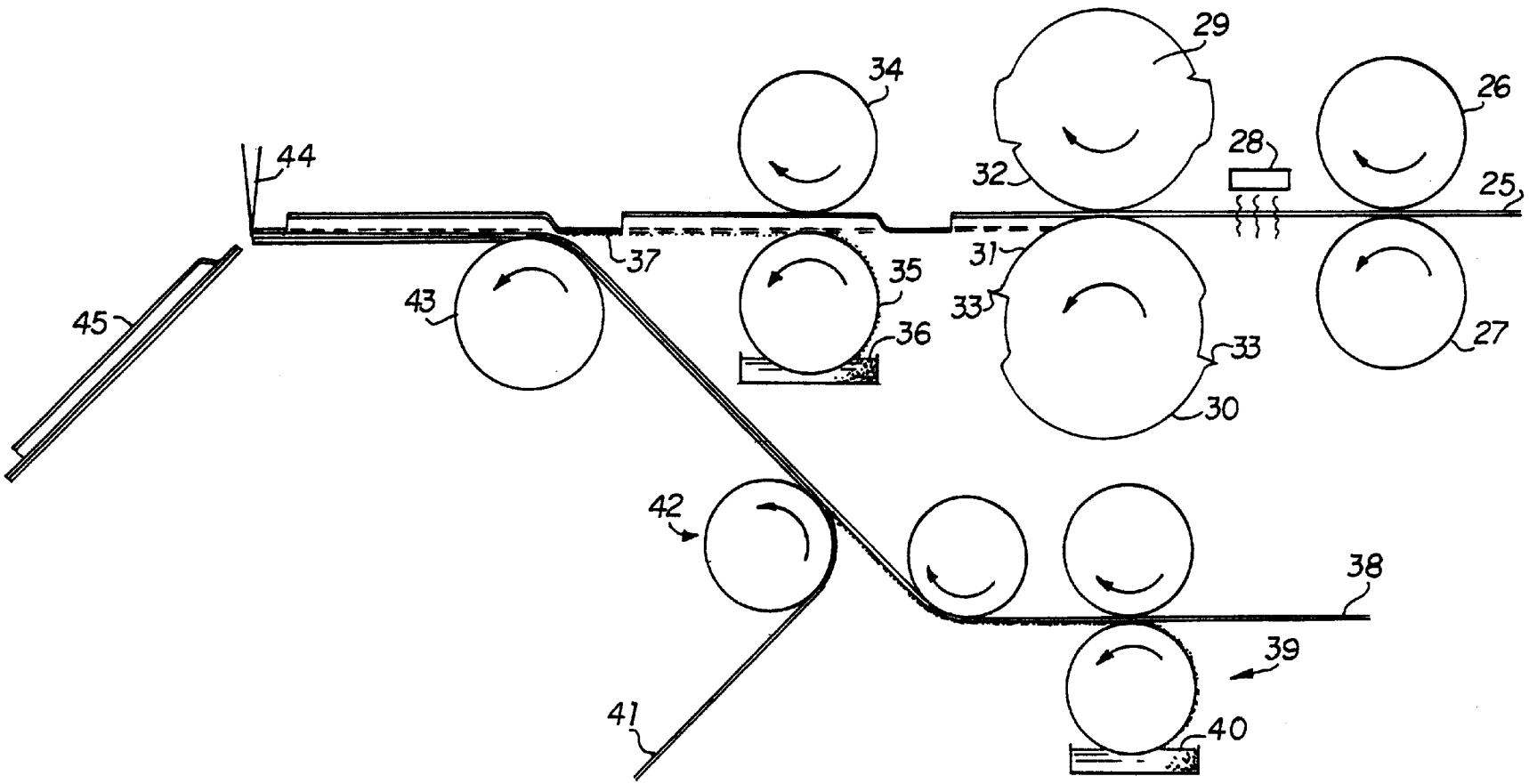
FIG. 3 is a diagrammatical illustration of its manufacturing process.

FIG. 3 groups in a single diagram, the various processes involved in the manufacturing of the pocket. It should be noted that those various processes are not necessarily performed in line and simultaneously but can be done at different times.

A web or ribbon of pliable sheet material 25 is first run through a pair of printing rollers 26, 27 which apply to its top surface a graphic decoration or printed message. The web is then left to dry or passed through a drying station 28 before being fed through a pair of embossing rollers 29, 30. The surfaces of those two rollers have mating opposite raised and depressed areas 31, 32 corresponding to the desired embossing pattern. One of the rollers mounts a perpendicular blade 33 which cuts the slit 18 in the upper edge of the central section 12 of the pocket. The embossed web is then run through another pair of rollers 34, 35. The surface of roller 35 on the back side of the web is constantly being loaded with the rubber-based, hot-melt adhesive 36 and contact only the non-embossed sections 37 of the web.

On a separate track, a similar ribbon or web 38 is first passed by another adhesive-applying roller mechanism 30 that coats its back side with the high-tack acrylic compound 40. A web 41 of peelable, protective film is then laid over the adhesive by another roller mechanism 42. The three webs 25, 38 and 41 are then brought together in a final assembling process before passing through a cutting knife 44 that separates the various pocket devices 45.

It should be understood that additional printing or decorating could be applied to either side of the second and third webs 38, 41.

FIG. 4 illustrates a second embodiment of the invention in which a pocket 46 of a less complex configuration has been formed over a woven fabric section 47 of a garment surface. In this embodiment, the intermediary sheet 16 of the first embodiment has been completely omitted. The high-tack, acrylic adhesive has been applied to the back 48 of the marginal, not raised, peripheral section 49 of the single sheet for direct application to the garment woven fabric surface. The central portion 50 has been provided with side gussets 51, 52 which allow for a larger volume content of the pocket. The opening slit 53 is temporarily sealed by a peelable tape 54 allowing the pocket to be used as a container for candy or other items until the adhesive-protecting, peelable film 55 shown in dotted line is removed.

In an alternate manufacturing process, the entire back 48 of the single sheet is covered with the acrylic adhesive and covered with a commensurate peelable film 55. However, the central part of the film is peripherally cut to delineate the pocket compartment. That central part thus remains in place when the film 55 is peeled away from one of the corners. Only the adhesive-coated back of the peripheral section 49 is exposed and bonded to the fabric section 47. The central part of the film remains as an inner lining of the pocket. A second alternate manufacturing method consists of chemically neutralizing the central portion of the acrylic adhesive. These alternate processes can be conveniently practiced on presses used in the manufacture of die-cut pressure-sensitive labels. The gussets 51, 52 may be formed either by embossing or by preforming the central section 50 separately out of one or more compartments It should be understood that the same type of sealed container can be more conveniently implemented in connection with the earlier described preferred embodiment 10 of the invention.

Figure 5:
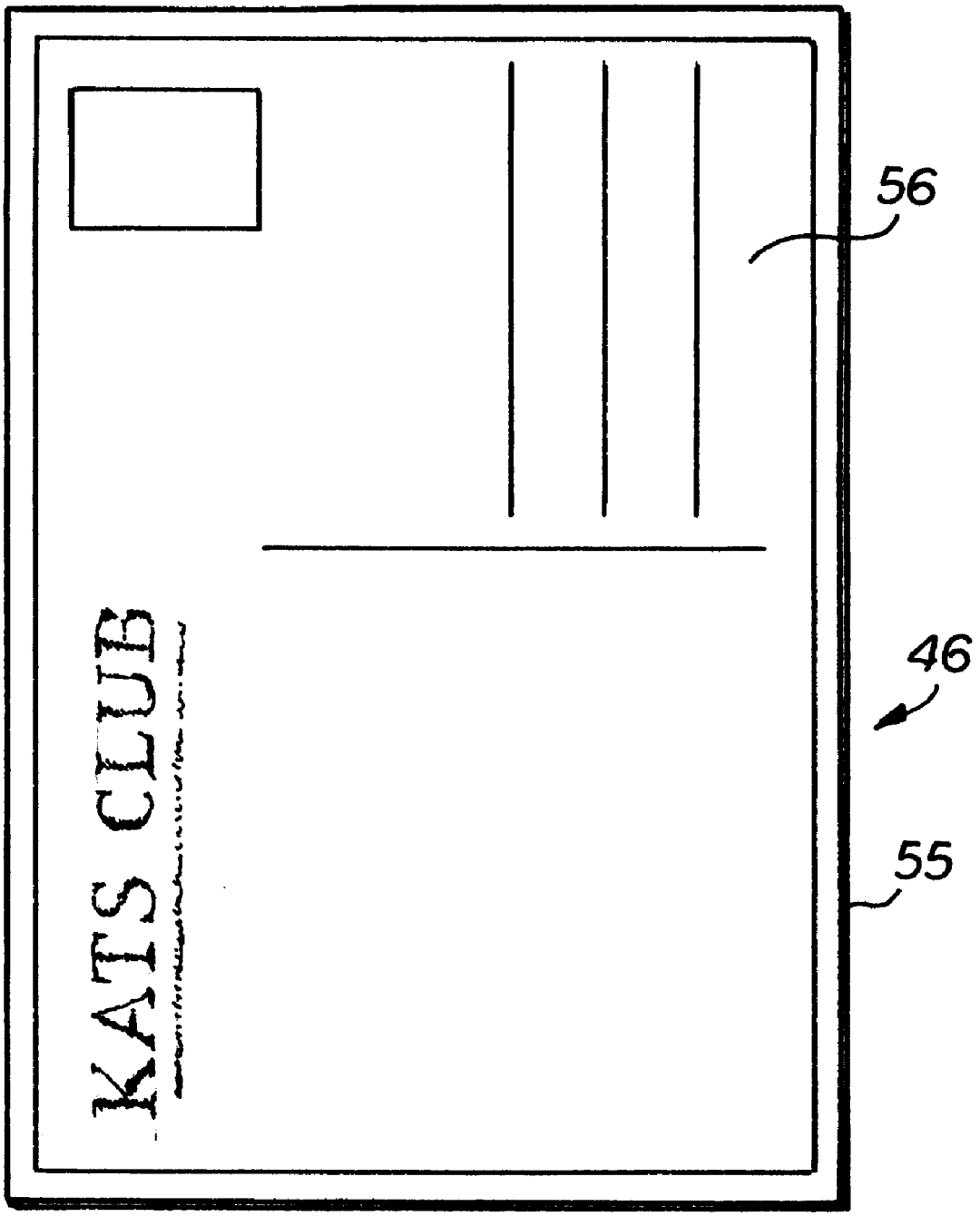
FIG. 5 is a back elevational view thereof.

As shown in FIG. 5, the peelable, protectable film 21, 55 of either one of the above-described embodiments of the invention is preferably printed with a postcard format 56 including dedicated areas for address, stamp and correspondence, thus turning the devices into mailing containers or postcards that can double as disposable pockets. This back-printing process can be conveniently done by roller 42 or roller 43 of FIG. 3.

Figure 6:
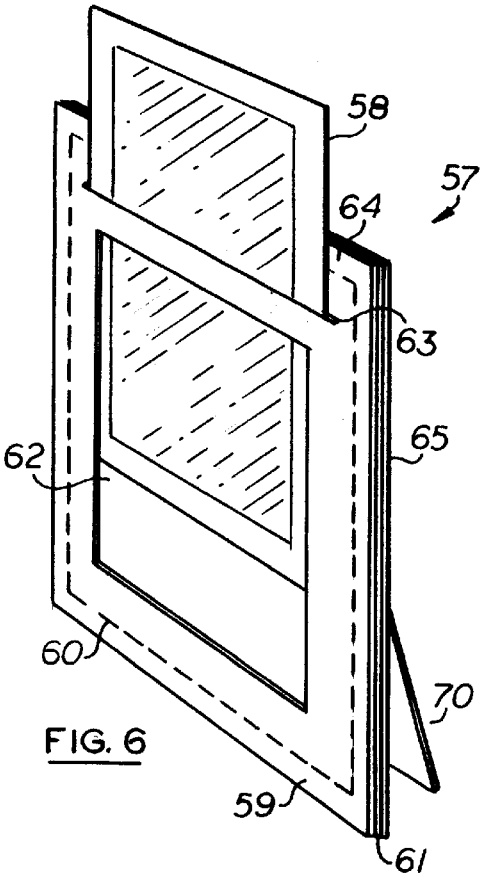
FIG. 6 is a front perspective view of a first document pocket display device.
Figure 7:
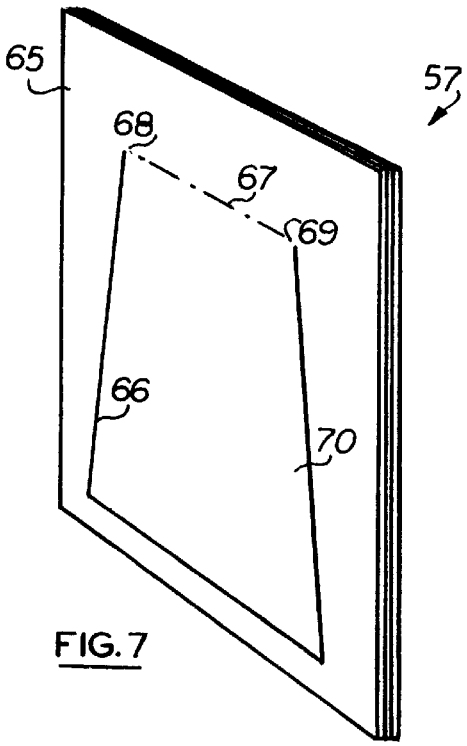
FIG. 7 is a back perspective view thereof.

As illustrated in FIG. 6, a third embodiment of the invention consists of a display device 57 for a document 58 such as a photograph. As in the first two embodiments, the first sheet 59 is bonded along its periphery, shown in dotted line, with a strong adhesive to to the intermediary sheet 61. In addition, the first sheet has a large central cutout 62 through which the document 58 can be seen. A slit 63 cut through the first sheet between the central cutout 62 and the top peripheral edge 64 allows for inserting the document between the first and intermediary sheet.

The third waxed sheet 65 which is bonded to the back of the intermediary sheet with a weaker adhesive is preferably made of a thick stock of paper. The third sheet, is slit along a three-section, non-linear line 66 leaving a gap 67 between opposite ends 68 and 69 of the slit. Accordingly, that portion 70 of the third sheet delineating by the slit and the gap 67 can be conveniently detached from the back of the intermediary sheet, and folded about the gap 67 to form a supporting foot as shown in FIG. 6.

Figure 8:
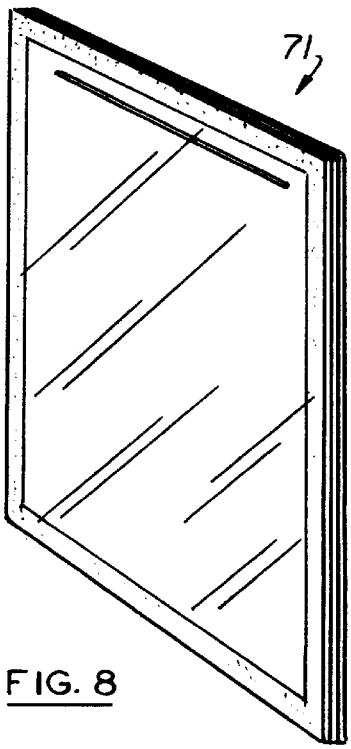
FIG. 8 is a front perspective view of a second document pocket display device.
Figure 9:
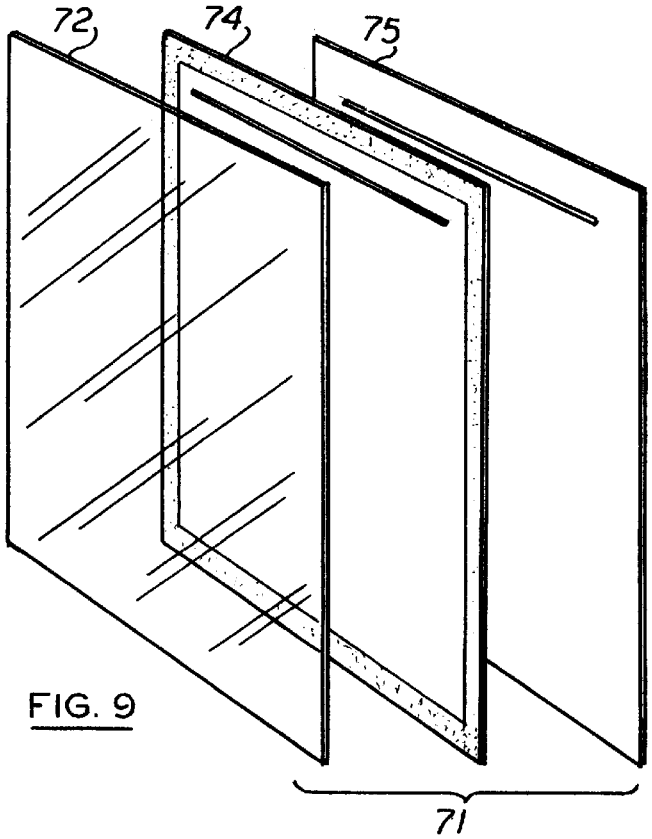
FIG. 9 is an exploded view thereof.

In the fourth embodiment of the invention 71 illustrated in FIGS. 8 and 9, the first sheet 72 is totally transparent, thus exposing along its periphery, the marginal area that is bonded to the intermediary sheet 74. In this embodiment, the slit through which a document can be inserted into the pouch is cut not in the first sheet, but in the intermediary and third sheet 75.

It should be understood that the various features of the above-described embodiments can be shared among them. For instance, the fourth embodiment could be provided with the supporting foot 70 of the third, and the first transparent sheet could be embossed like in the first embodiment of the invention.

Figure 10:
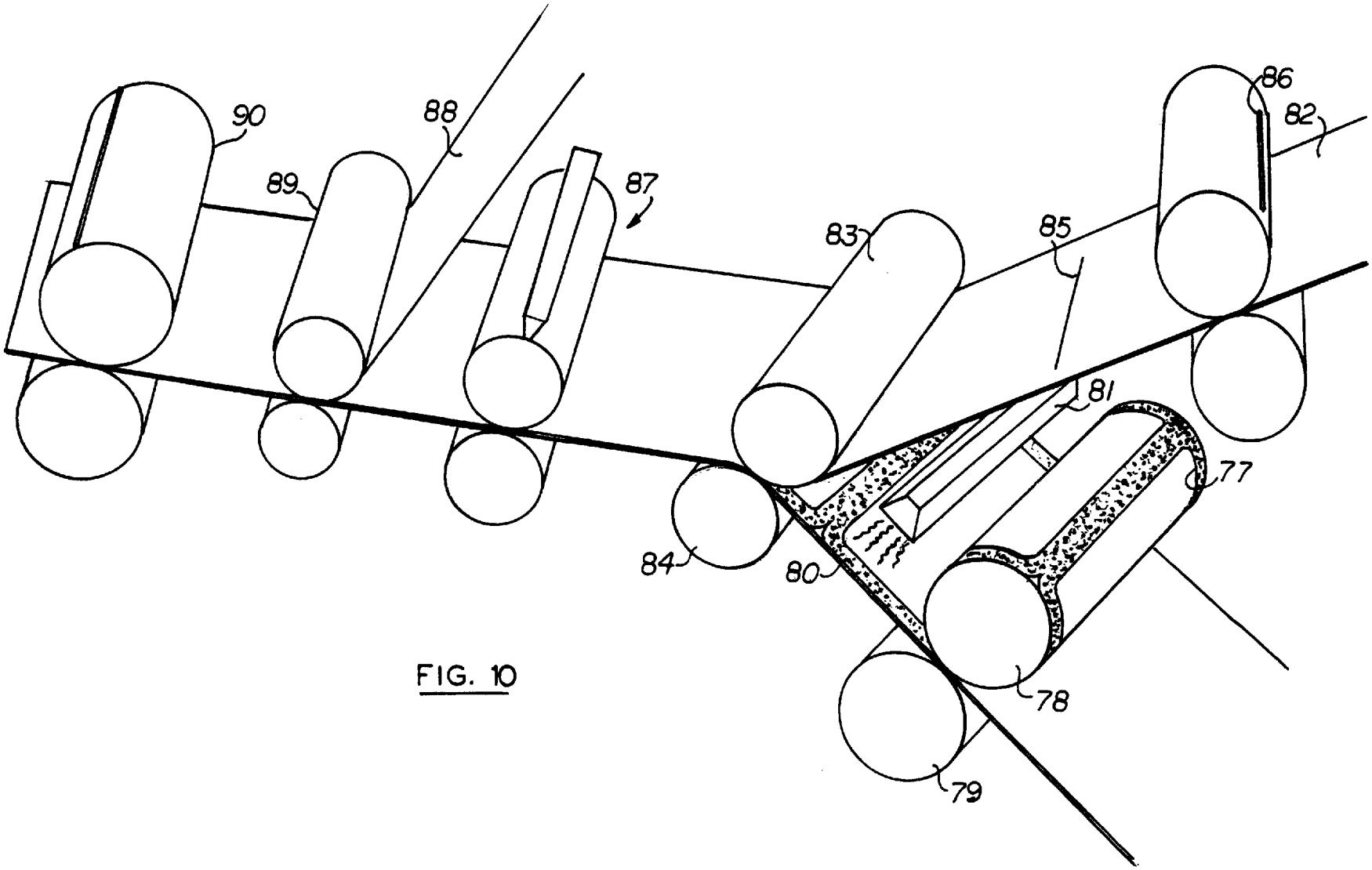
FIG. 10 is a diagrammatical view of one of the device manufacturing methods.

In the manufacturing method illustrated in FIG. 10, the back, or inner side of a first web that forms the third sheet of the pockets, is printed with the peripheral glue pattern 77 through a first printing press represented by two rollers 78 and 79. A common rotary flexo press can be used for that purpose by substituting glue instead of ink. If the web is made of a non-porous material such as vinyl, it is advantageous to partially pre-dry the glue pattern 80 by exposing it to an ultraviolet light 81. This step removes most of the moisture from the adhesive before the first web is contacted with the second web 82 that will form the intermediary sheets of the pockets when both webs are calendered by a second pair of rollers 83 and 84.

It should be noted that the document insertion slit 85 can be cut by means of a roller dye 86 before the two webs are merged. The high-tack acrylic adhesive is applied to the entire back face of the second web 82 by roller assembly 87 before the third web 88 is laid over the adhesive by roller assembly 89. Either one of rollers 79 or 84 could be used to print information on the front face of the first web.

Finally, a die-roller assembly 90 is used to cut the assembled webs into individual pockets. It should be understood that the document insertion slit could be alternatively cut into the first web or into the third web as well as the second. Similarly, the glue pattern could be applied to the front, contacting face of the second web rather than the back of the first web.

It should also be understood that while the method is illustrated in connection with printing presses, the same method could be applied with platen or job presses where and array of pockets could be delineated, then printed according to the above teachings.

While the preferred embodiments of the invention have been described, modifications can be made and other embodiments may be devised without departing from the spirit of the invention and the scope of the appended claims.

What is claimed is:

1. A disposable display pocket, removably bondable to a support surface, said pocket comprising:

a first unitary, flat and flexible sheet of material including a central portion and a continuous peripheral portion completely surrounding said central portion;

a second sheet of flexible material being substantially commensurate with and lying flatly against said first sheet, and having an outer side including a central portion and a marginal portion permanently bonded to said entire continuous peripheral portion, and an inner side having a layer of adhesive for removably sticking upon said support surface; and wherein one of said first and second sheets has a slit opening in said central portion thereof.

2. The pocket of claim 1, wherein said first sheet has a transparent central portion exposing part of said second sheet outer side central portion.

3. The pocket of claim 2, wherein said first sheet is made of transparent material.

4. The pocket of claim 1, wherein said first sheet has a central aperture, distal from said slit.

5. The pocket of claim 1, which further comprises a detachable sheet covering said layer of adhesive, said detachable sheet comprising a first face having a low friction coefficient with said adhesive, and a back face, whereby said detachable sheet can be manually separated from said inner side to expose said layer of adhesive.

6. The pocket of claim 5, wherein said back face carries printed information.

7. The pocket of claim 6, wherein said back face further comprises a blank area suitable for receiving written information; and a corner spot shaped and dimensioned to accept at least one postage stamp.

8. The pocket of claim 5, wherein said detachable sheet has a non-linear slit having distal first and second ends separated by a gap, whereby an area delineated by said slit and gap can be pulled away and folded about said gap to form a supporting leg.

9. The pocket of claim 2, further including a document inserted between said first and second sheet, said document having information visible through said first sheet.

10. The pocket of claim 1 which further comprises a removable sealing strip over said slit.

11. A process for forming a series of pockets releasably attachable to a supporting surface which comprise the steps of:

delineating successive areas defining said pocket outlines over a first web of flexible sheet material;

applying by means of a printing press, as strong adhesive to a marginal peripheral portion of a face of each of said areas;

applying a breakable high-tack adhesive to an inner side of a second web of flexible sheet material substantially commensurate with said first web;

covering said inner side with a removable third web of flexible sheet material substantially commensurate with said second web;

contacting said inner face of said first web with an outer side of said second web opposite said inner side for permanently securing said marginal peripheral portion of said inner face of said first web to the said outer side; and cutting a slit through a part of each of said areas, in one of said first and second webs, surrounded by a peripheral portion; and cutting said assembled webs into said delineated areas.

12. The process of claim 11 which further comprises embossing each of said areas to place a central portion exclusive of said peripheral portion in a plane parallel to and spaced-apart from, said second web.

13. The process of claim 11 which further comprises cutting non-linear slits in said third web, said slits having distal first and second ends separated by a gap.

14. A process for forming a series of pockets releasably attachable to a supporting surface which comprises the steps of:

delineating successive areas defining said pocket outlines over a first web of flexible sheet material;

applying a breakable high-tack adhesive to an inner side of a second web of flexible sheet material substantially commensurate with said first web;

covering said inner side with a removable third web of flexible sheet material substantially commensurate with said second web;

contacting said inner face of said first web with an outer side of said second web opposite said inner side, and permanently securing a continuous and close marginal pheripheral portion of said inner face of said first web to the said outer side; and cutting a slit through a part of each of said areas, in one of said first and second webs, surrounded by a peripheral portion; and cutting said assembled webs into said delineated areas.

15. The process of claim 14 which further comprises cutting non-linear slits in said third web, said slits having distal first and second ends separated by a gap.

16. The process of claim 14 which further comprises printing information on an exposed face of said third web.

* * * * *